US005553405A

United States Patent [19]

Hayashi et al.

[11] Patent Number: 5,553,405

[45] Date of Patent: Sep. 10, 1996

[54] POWER-ASSISTED SHOVEL TRUCK EQUIPPED WITH A WATER-FEEDING DEVICE AND A WATER-DRAINING DEVICE

[75] Inventors: Hiroshi Hayashi, Yamaguchi-ken; Tadashi Miyoshi, Kudamatsu, both of Japan

[73] Assignees: Toshihiro Industry Co., Ltd., Yanai; Miyoshi Co., Ltd., Kudamatsu, both of Japan

[21] Appl. No.: 278,095

[22] Filed: Jul. 21, 1994

[51] Int. Cl.[6] ..... F02F 3/24

[52] U.S. Cl. ..... 37/189; 37/903; 37/187; 37/186; 294/68.23; 285/134; 285/136

[58] Field of Search ..... 37/185, 186, 187, 37/188, 189, 903, 410, 406, 408, 347; 285/134, 136; 403/165; 169/70, 15, 24; 414/726; 239/129, 146, 176, 195, 198; 294/63.23

[56] References Cited

U.S. PATENT DOCUMENTS

| | | | |
|---|---|---|---|
| 3,016,201 | 1/1962 | Brogden | 239/164 |
| 3,165,109 | 1/1965 | Hammelmann | 239/198 X |
| 3,567,136 | 3/1971 | Garrett | 285/134 X |
| 4,497,608 | 2/1985 | Sheppard et al. | 37/188 X |
| 4,542,929 | 9/1985 | Possinger | 37/186 X |
| 4,593,855 | 6/1986 | Forsyth | 169/24 |
| 4,633,601 | 1/1987 | Fleck et al. | 414/726 |
| 4,700,894 | 10/1987 | Grzych | 169/70 X |
| 4,832,263 | 5/1989 | Poynor | 239/198 X |
| 5,113,946 | 5/1992 | Cooper | 169/24 |
| 5,140,759 | 8/1992 | Artzberger | 37/347 |
| 5,156,422 | 10/1992 | Shibano | 285/136 X |
| 5,199,196 | 4/1993 | Straley | 37/403 X |
| 5,295,317 | 3/1994 | Perrott | 37/347 X |
| 5,299,370 | 4/1994 | Gyori et al. | 37/905 X |
| 5,375,348 | 12/1994 | Kishi | 37/186 |
| 5,404,660 | 4/1995 | Webster | 37/189 |

FOREIGN PATENT DOCUMENTS

| | | |
|---|---|---|
| 61-207728 | 9/1986 | Japan . |
| 62-240295 | 10/1987 | Japan . |
| 5-247962 | 9/1993 | Japan . |

*Primary Examiner*—Randolph A. Reese
*Assistant Examiner*—Victor Batson
*Attorney, Agent, or Firm*—Finnegan, Henderson, Farabow, Garrett and Dunner

[57] ABSTRACT

A power-assisted shovel truck is provided including a swiveling truck and a rotary bucket attached to the truck by a movable arm. A water feed pump and a water feed tank are provided on the truck for pumping water towards the rotary bucket. A conduit communicates with the water feed pump and runs along the arm to the bucket to feed a stream of water to the rotary bucket.

17 Claims, 5 Drawing Sheets

POWER-ASSISTED SHOVEL TRUCK EQUIPPED WITH A WATER-FEEDING DEVICE AND A WATER-DRAINING DEVICE

BACKGROUND OF THE INVENTION

1. Field of the Invention

The present invention relates to a power-assisted shovel truck equipped with a water-feeding device and a water-draining device. More specifically, the present invention relates to a power-assisted shovel truck capable of feeding water to a bucket at its front and of draining turbid water that hinders visibility during ground excavation.

2. Discussion of the Related Art

Conventional power-assisted shovel trucks are equipped with a rotary bucket device having a mechanism that opens and closes to hold materials. Japanese Laid-Open Nos. 207728/1986 and 240295/1987 disclose such shovel trucks. The holding mechanism of the rotary bucket of these conventional shovel trucks consists of jaws actuated by a hydraulic cylinder. A hydraulic motor drives the rotary bucket so that it fully rotates. A swivel joint near the shaft of the rotary bucket allows the free rotation. Hydraulic pressure is fed through the swivel joint to the hydraulic cylinder that opens and closes the jaws of the holding mechanism. These shovel trucks exhibit high power for performing a variety of functions, for example, digging the earth, holding concrete blocks, and pouring raw concrete.

Although superior to other conventional rotary inclination-adjustable buckets or manually rotated fixed buckets, the rotary buckets as described hereinabove exhibit some limitations. For example, when used to transport raw concrete, the semi-solidified raw concrete adhered to the bucket surfaces tends to increase the weight of the bucket, decrease the effective capacity of the bucket, and hinder the operation and movement of the bucket and its jaws. Similar problems occur during excavation of earth and sand. These buckets require continual cleaning causing work interruption. The bucket is typically cleaned by spraying water onto the bucket while brushing it. This task is laborious and often dangerous.

In addition, ground excavation is often facilitated by first feeding water to the ground in order to make the earth and sand muddy and, therefore, easier to excavate. The water is then sucked and drained from the earth and sand. Conventional devices, however, do not simultaneously excavate and feed the water.

Similarly, the dismantling of, for example, a house or other structure, generates large amounts of dust and dirt unless water is sprayed onto the dismantled structure. Conventional shovel devices do not supply the water, as water must be manually sprayed from a hose.

SUMMARY OF THE INVENTION

The present invention has been made in view of the above circumstances and has as an object to provide a power-assisted shovel truck capable of feeding a stream of water to a rotary bucket device or draining water from a location proximate the rotary bucket device so as to facilitate and to limit the danger and man power involved in various operations, such as excavation, dismantling, holding, cleaning, cooling, and fire extinguishing, for example.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the power-assisted shovel truck of this invention includes a swiveling truck and a rotary bucket attached to the truck by a movable arm. A water feed pump and a water feed tank are provided on the truck for pumping water towards the rotary bucket. A conduit communicates with the water feed pump and runs along the arm to the bucket to feed a stream of water to the rotary bucket.

According to another aspect of the invention, there is provided the power-assisted shovel truck as hereinabove described and further including a water drain pump and a water drain tank provided on the truck. The conduit communicates with the water drain pump to drain water from an area proximate the rotary bucket.

BRIEF DESCRIPTION OF THE DRAWINGS

The accompanying drawings, which are incorporated in and constitute a part of this specification, illustrate embodiments of the invention, and together with the description, serve to explain the objects, advantages and principles of the invention. In the drawings.

DETAILED DESCRIPTION OF THE PREFERRED EMBODIMENT

Figure 1:
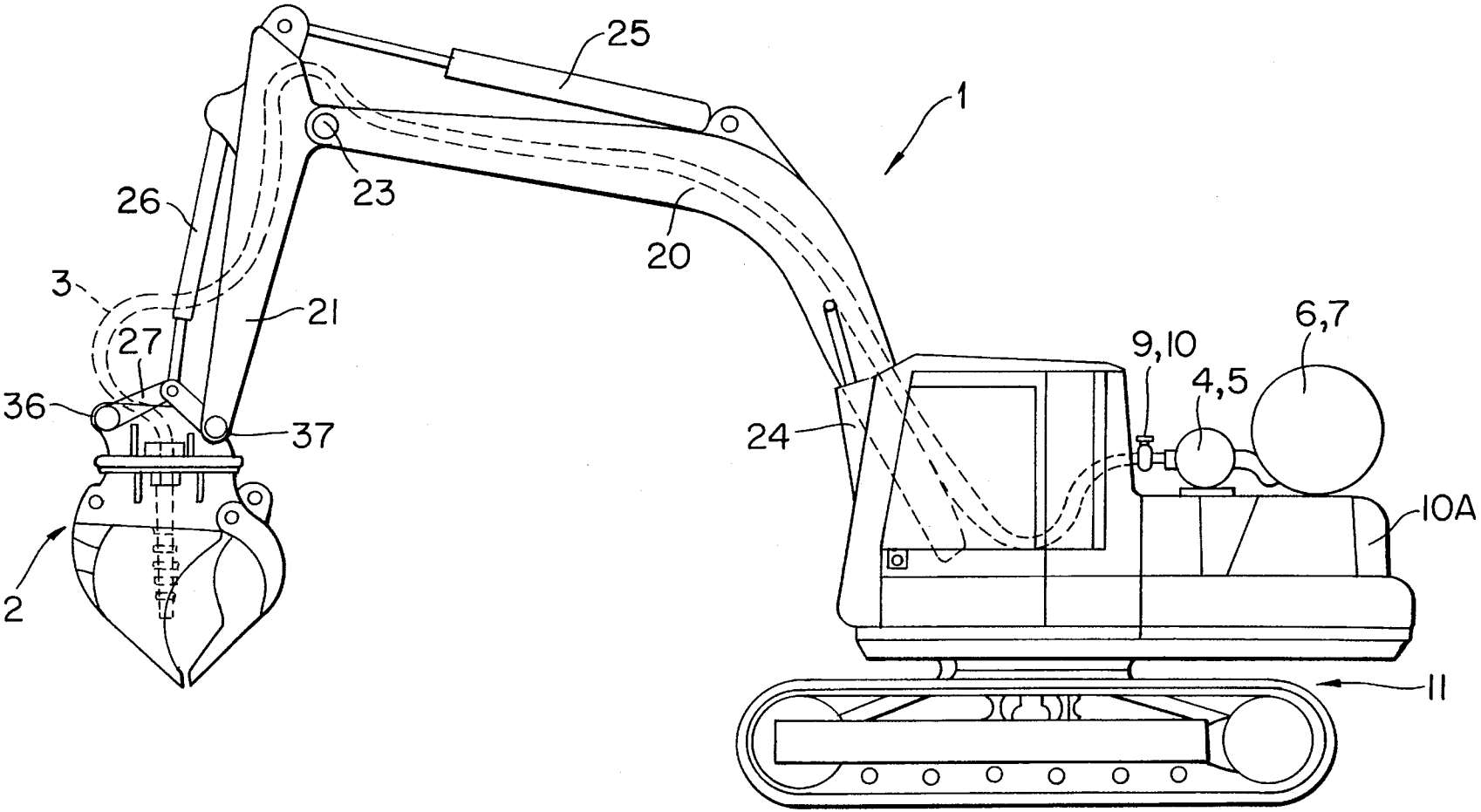
FIG. 1 is a side view of an embodiment of the power-assisted shovel truck according to the present invention.

An embodiment of a power-assisted shovel truck according to the present invention is illustrated in FIG. 1. The power-assisted shovel truck 1 generally includes a rotary bucket device 2 and a hose 3. A water-feeding pump 4, water-draining pump 5, water-feeding tank 6, water-draining tank 7, and valves 9 and 10 are arranged on a chassis 10A of a swiveling truck 11. The feeding pump 4 and the feeding tank 6 are interconnected, as are the draining pump 5 and the draining tank 7. The pumps 4 and 5 are both driven by a hydraulic motor (not shown).

The power-assisted shovel truck 1 further includes first and second arms 20 and 21 and a shaft 23 interconnecting the arms 20 and 21. Two hydraulic cylinders 24, located on opposite sides of the first arm 20, drive the first arm 20. A sole hydraulic cylinder 25 drives the second arm 21, which pivots about the shaft 23. The hydraulic cylinders 24 and 25 are remotely operated by an operator located within the truck 11.

The power-assisted shovel truck 1 according to the present invention and as embodied in FIG. 1 further includes a shaft 37 from which the rotary bucket 2 pivots. The tilt of the rotary bucket 2 is adjusted by a hydraulic cylinder 26 and a tilting link 27 connected to the bucket 2 via a shaft 36. The hydraulic cylinder 26 and link 27 are also remotely operated from within the swiveling truck 11.

Figure 2:
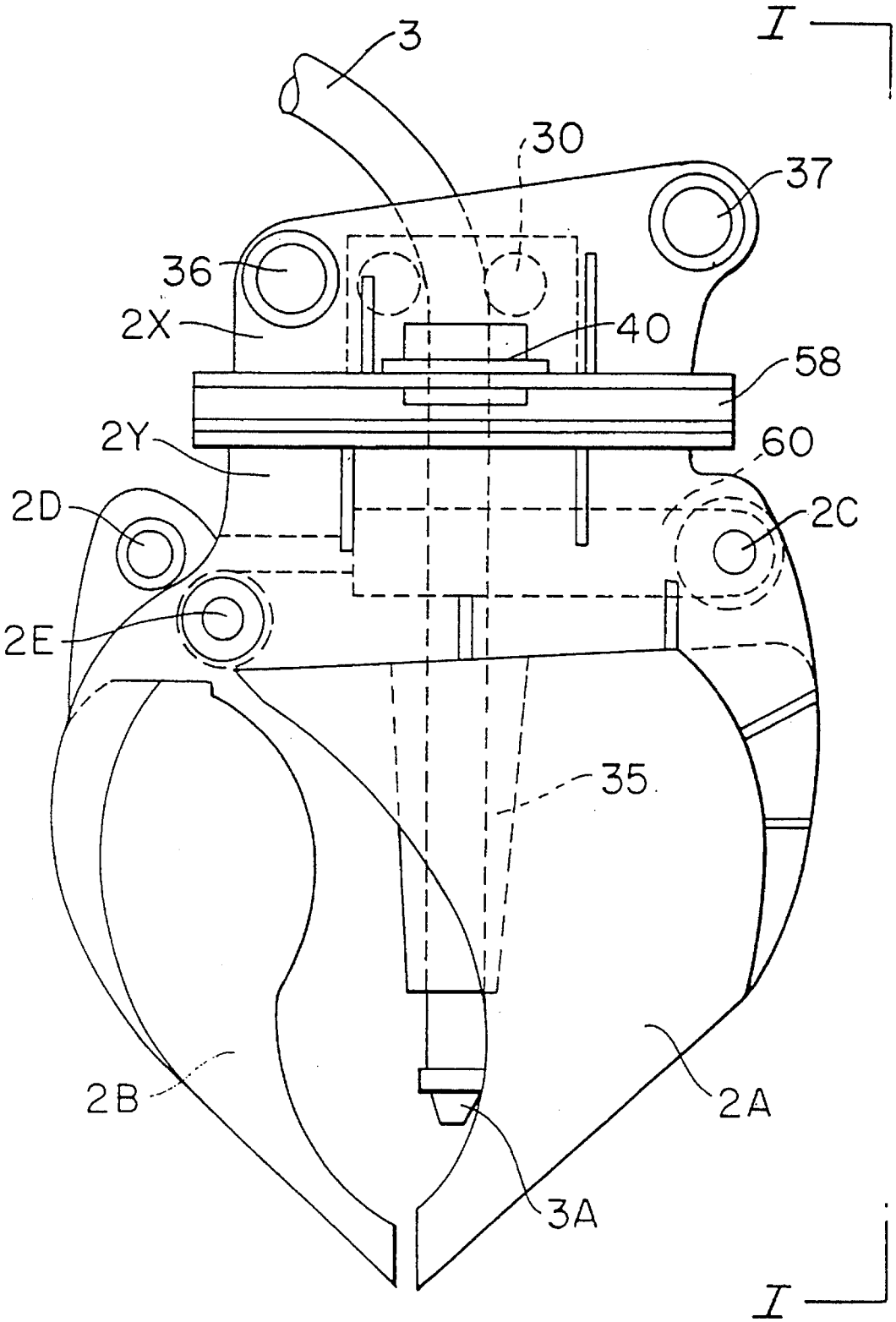
FIG. 2 is a side view of a rotary bucket of the power-assisted shovel truck shown in FIG. 1.
Figure 3:
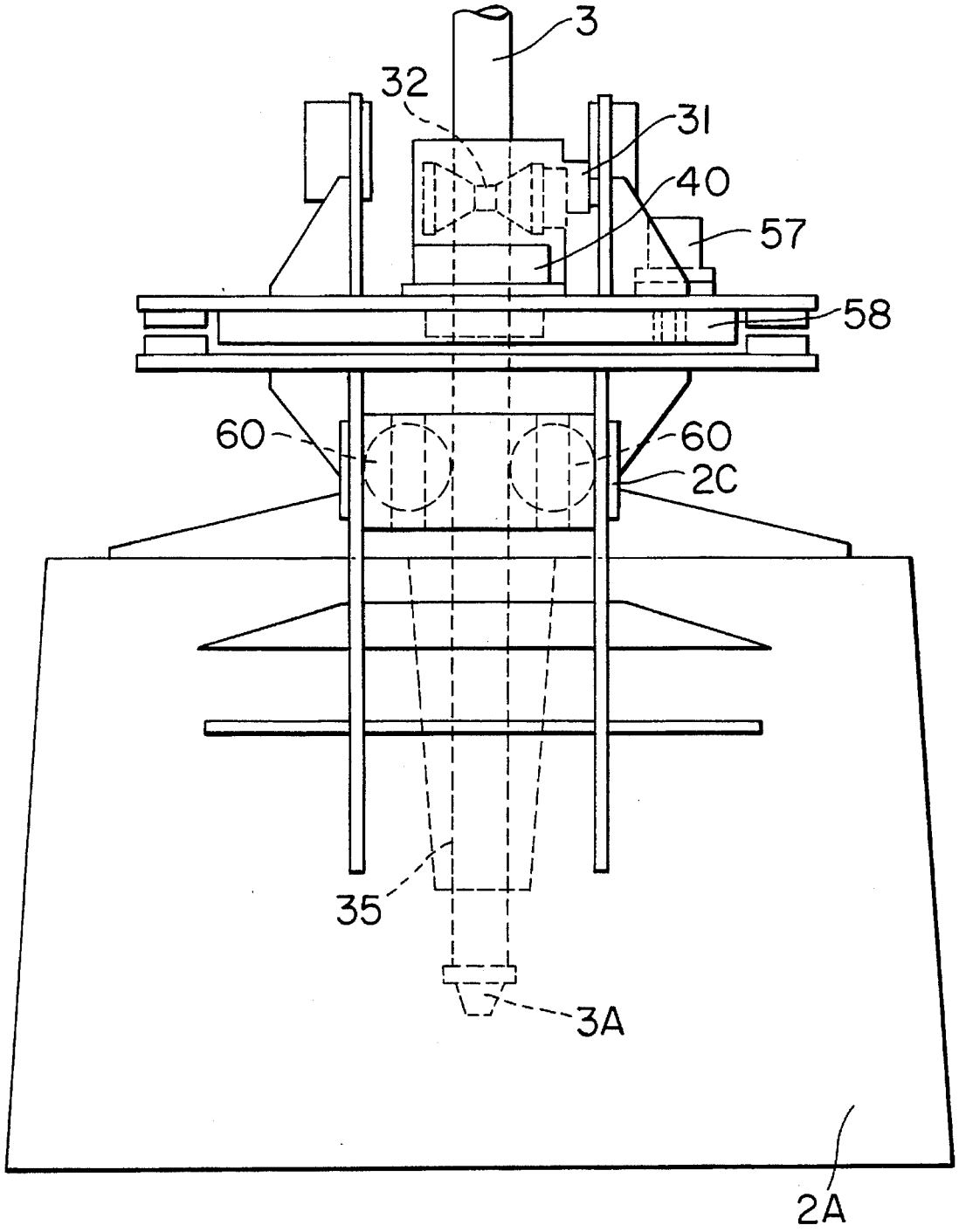
FIG. 3 is a side view of the rotary bucket of FIG. 2 along line I—I.

Hoses (conduits) extend from the pumps 4 and 5 at the valves 9 and 10, along the first and second arms 20 and 21, to the rotary bucket 2. As shown in FIGS. 2 and 3, the hose 3 passes through a hose drive unit 30, a hollow swivel joint (hydraulic pressure passage) 40, and a hose-supporting sheath 35. The hose ultimately faces the opening portion of the bucket 2 and is retractable from the interior of the bucket 2, as will be described herein.

Various nozzles 3A can be connected to the front end of the hose 3 to alter the velocity of the water stream or to spray the water. It is important that the supporting sheath 35 be comprised of, for example, a telescopic metallic, rubber, or plastic tube, or the like, having a number of bellows. A coil spring is often contained within the tube. The end of the hose 3 is firmly held by the sheath 35 so as to not be subject to damage by a material held by the bucket 2.

The hose drive unit 30 includes a pair of drum rolls 32 that engage the hose 3 on opposite sides of the hose 3. A hydraulic motor 31 drives the drum rolls 32 to retractably adjust the position of the hose.

As shown in FIG. 2, the bucket 2 includes a fixed jaw 2A, a moving jaw 2B, shafts 2C, 2D, and 2E, a rotary bucket base body 2X, and a rotary bucket main body 2Y. The rotary bucket main body 2Y rotates with respect to the rotary bucket base body 2X via a rotary ring 58. The rotation of the main body 2Y is controlled by a hydraulic motor 57 (FIG. 3) driving a pinion gear that is in mesh with a ring gear formed along the inner surface of the rotary ring 58. Once again, the rotation of the main body 2Y is remotely controlled by an operator within the swiveling truck 11.

Two hydraulic cylinders 60 connect at their ends to the shafts 2D and 2C to drive the moving jaw 2B, which pivots from the bucket main body 2Y at the shaft 2E. The use of two hydraulic cylinders 60 on opposite sides of the hose 3, in combination with the drum rolls 32, keeps the hose 3 centered and away from the jaws 2A and 2B.

Figure 7:
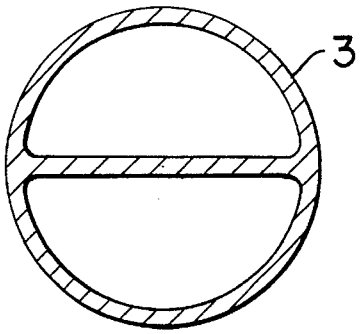
FIG. 7 is a cross sectional view of an embodiment of a hose used in the power-assisted shovel truck shown in FIG. 1.
Figure 8:
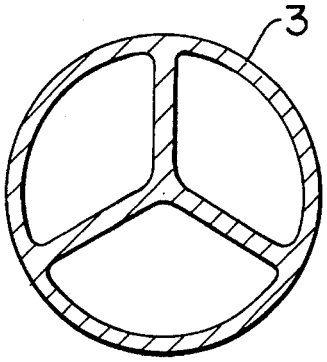
FIG. 8 is a cross sectional view of a second embodiment of a hose used in the power-assisted shovel truck shown in FIG. 1.
Figure 9:
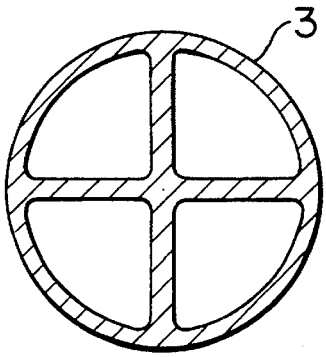
FIG. 9 is a cross sectional view of a third embodiment of a hose used in the power-assisted shovel truck shown in FIG. 1.

The hose 3 preferably has a hollow circular cross section. Other preferred shapes include the modified cross sections shown in FIGS. 7, 8, and 9. The rigid shapes shown in these figures are preferably positioned proximate the swivel joint 40. The remainder of the hose may constitute ordinary hollow circular portions. If the stroke for adjusting or retracting the hose is relatively small, a more rigid metallic pipe may be employed for that portion of hose moving up and down.

Figure 4:
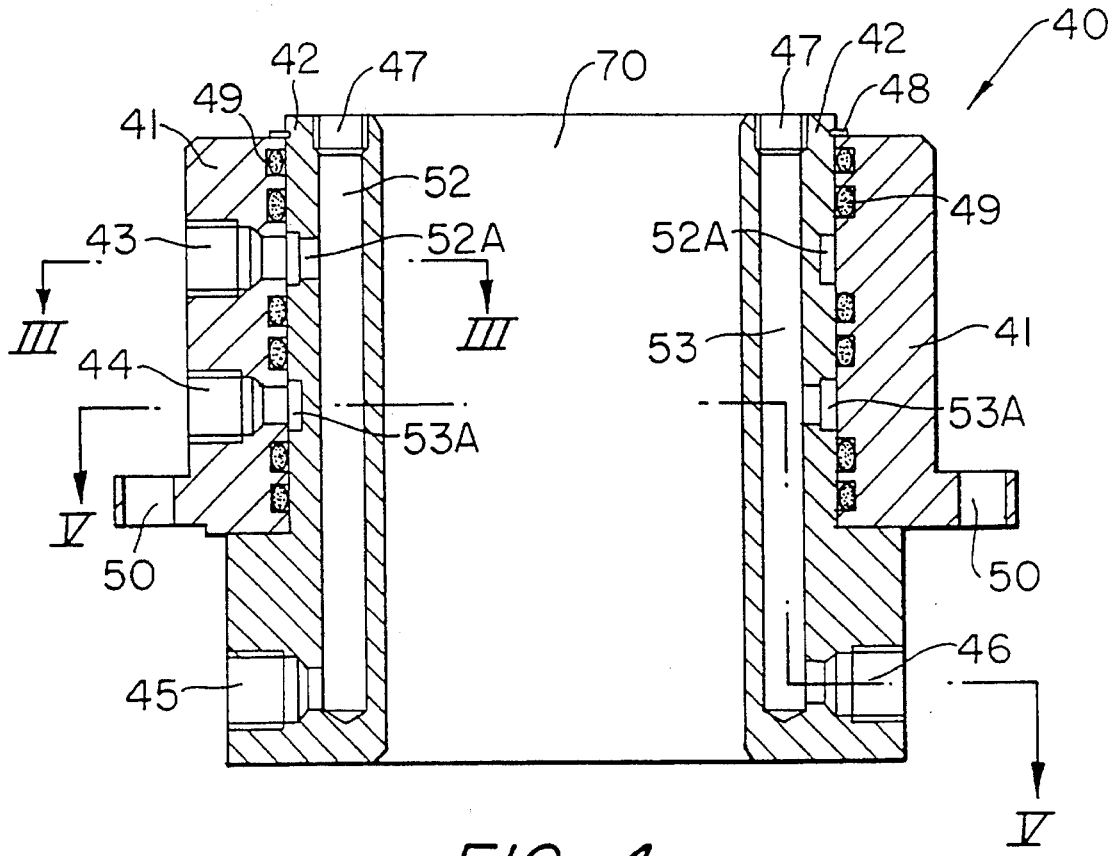
FIG. 4 is a cross sectional view of a swivel joint used in the rotary bucket of FIG. 2.
Figure 5:
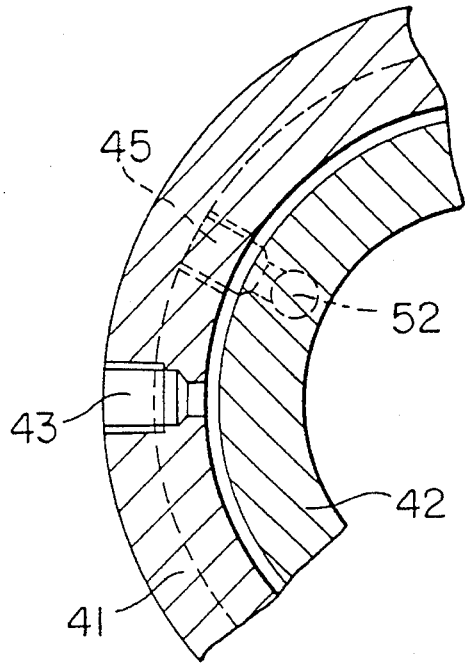
FIG. 5 is a partial cross sectional view of the swivel joint of FIG. 4 along line III—III.

The hollow swivel joint 40 will be described with reference to FIGS. 4–6. In FIGS. 4 and 5, an inner case 42 is fitted on the inside of an outer case 41 via three pairs of O-rings 49. Holes 50 for inserting mounting bolts are formed in a flange portion of the outer case 41. Hydraulic pressure inlet/outlet ports 43 and 44 are formed within the wall of the outer case 41. The hydraulic pressure inlet/ outlet port 43 communicates with a vertical hydraulic pressure passage 52 via an annular groove 52A in the inner case 42. The pressure passage 52 connects port 43 to a lower hydraulic pressure inlet/outlet port 45. A blind plug or cover 47 screws onto and closes the upper end of the passage 52.

Figure 6:
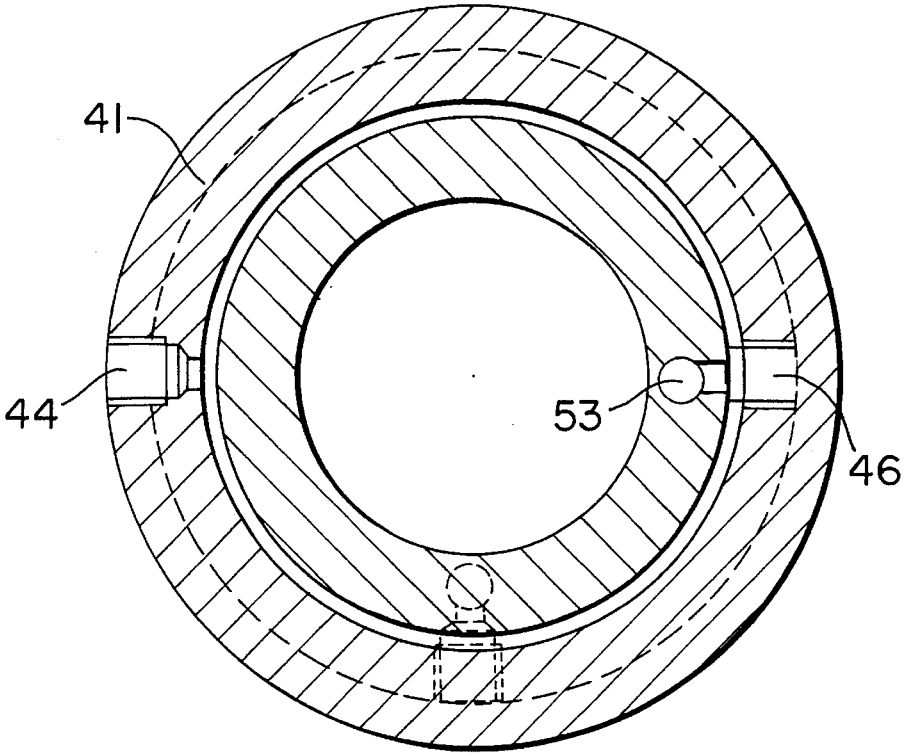
FIG. 6 is a cross sectional view of the swivel joint of FIG. 4 along line V—V.

As shown in FIGS. 4 and 6, the hydraulic pressure inlet/outlet port 44 communicates with a vertical hydraulic pressure passage 53 via an annular groove 53A in the inner case 42. The passage 53 connects port 44 to a lower hydraulic pressure inlet/outlet port 46. The upper end of the hydraulic pressure passage 53 is closed by the cover 47 screwed thereon.

A snap ring 48 fitted onto the upper end of the inner case 42 prevents the inner case 42 from being disconnected from the outer case 41. O-rings 49 provide a seal for the hydraulic pressure inlet/outlet port 43 and the annular groove 52A and for the hydraulic pressure inlet/outlet port 44 and the annular groove 53A.

The swivel joint 40 according to the present invention includes a hollow cylindrical portion 70 of a large diameter at the center of the joint 40. The hose 3 freely moves up and down through the hollow cylindrical portion 70.

Hydraulic pressure is fed to the hydraulic cylinders 60 by the swivel joint 40 in order to drive the moving jaw 2B. The hydraulic pressure is supplied irrespective of the angle (rotation) of the rotary bucket main body 2Y. The operation of the swivel joint 40 and, therefore, the hydraulic cylinders 60 is remotely controlled from within the swiveling truck 11.

The power-assisted shovel truck according to the present invention accomplishes a variety of functions. Namely, for example, excavation, demolition, holding, cleaning, cooling, and fire extinguishing can be performed with less danger and time as compared to conventional shovel trucks and methods. More specifically, hard sludge and rock, previously requiring an excavator or dynamite to destroy the rock, can be excavated by a very high pressure stream of water, and then drained. When dismantling, for example, a wooden house or other similar structure, less dust and dirt is generated as a water stream can be applied at less pressure. Further, during ground excavation, the power-assisted shovel truck sucks dirty water produced by the injection of high pressure water or leakage of water. Ice and snow can also be melted and removed from roofs, roads, and sidewalks by feeding hot water from the feeding tank 6 and through the hose 3.

The power-assisted shovel truck can also clean, for example, the surfaces or seams of concrete block walls, pavements, or other materials and structures. Additionally, the shovel can move and cool soil and earth, extinguish a fire, and cool and excavate the inner walls of a blast furnace. The rotary bucket 2 cleans easily after, for example, raw concrete is transported.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A power-assisted shovel truck comprising:

a swiveling truck;

a rotary bucket attached to the truck by a movable arm;

a water feed pump and a water feed tank provided on the truck for pumping water towards the rotary bucket; and a conduit communicating with the water feed pump and running along the arm to the bucket to feed a stream of water to the rotary bucket, said conduit having an end retractably located within the interior of the rotary bucket.

2. The power-assisted shovel truck according to claim 1, wherein the water feed pump drains water from an area proximate the rotary bucket to the water feed tank.

3. The power-assisted shovel truck according to claim 1, further comprising:

a water drain pump provided on the truck; and a water drain tank provided on the truck, wherein the conduit communicates with the water drain pump to drain water from an area proximate the rotary bucket.

4. The power-assisted shovel truck according to claim 1, wherein the conduit comprises a hose.

5. The power-assisted shovel truck according to claim 4, further comprising a nozzle at the end of the hose.

6. The power-assisted shovel truck according to claim 4, further comprising a hose drive unit for adjusting the position of the end of the hose.

7. A power-assisted shovel truck comprising:

a swiveling truck;

a rotary bucket attached to the truck by a movable arm;

a water feed pump and a water feed tank provided on the truck for pumping water towards the rotary bucket;

a hose communicating with the water feed pump and running along the arm to the bucket to feed a stream of water to the rotary bucket, the hose having an end proximate the rotary bucket; and a hose drive unit for adjusting the position of the end of the hose, the hose drive unit including a pair of drum rolls positioned on opposite sides of the hose and a drive motor for driving the drum rolls to retractably adjust the position of the end of the hose.

8. The power-assisted shovel truck according to claim 4, further comprising a sheath connected to the rotary bucket and having an inner hollow cylindrical portion for containing and supporting the end of the hose bucket.

9. The power-assisted shovel truck according to claim 7, wherein the rotary bucket includes a fixed jaw and a moving jaw, and wherein hydraulic cylinders open and close the moving jaw.

10. The power-assisted shovel truck according to claim 9, further comprising a swivel joint for applying hydraulic pressure to the hydraulic cylinders for opening and closing the moving jaw.

11. The power-assisted shovel truck according to claim 10, wherein a portion of the hose proximate the swivel joint has a circular cross section divided into equally sized subsections.

12. The power-assisted shovel truck according to claim 9, wherein two hydraulic cylinders for opening and closing the moving jaw are positioned on opposite sides of the hose and perpendicular to the pair of drum rolls so as to retain the hose within the center of the rotary bucket.

13. The power-assisted shovel truck according to claim 1, further comprising a pair of drum rolls positioned on opposite sides of the conduit to retractably adjust the position of the end of the conduit.

14. The power-assisted shovel truck according to claim 1, wherein the conduit passes through a sheath for supporting the conduit.

15. The power-assisted shovel truck according to claim 14, wherein the sheath telescopically adjusts.

16. The power-assisted shovel truck according to claim 1, wherein the conduit passes through a passage of a hollow swivel joint into the interior of the rotary bucket.

17. The power-assisted shovel truck according to claim 16, wherein the hollow swivel joint supplies hydraulic pressure to a pair of hydraulic cylinders for opening and closing a jaw of the rotary bucket.

* * * * *